US005532120A

United States Patent [19]

Yagihara et al.

[11] Patent Number: 5,532,120

[45] Date of Patent: Jul. 2, 1996

[54] SILVER HALIDE PHOTOGRAPHIC MATERIAL CONTAINING SELENIUM COMPOUND

[75] Inventors: Morio Yagihara; Hirotomo Sasaki; Hiroyuki Mifune, all of Kanagawa; Shinji Kato, Gifu, all of Japan

[73] Assignee: Fuji Photo Film Co., Ltd., Kanagawa, Japan

[21] Appl. No.: 539,043

[22] Filed: Oct. 4, 1995

Related U.S. Application Data

[63] Continuation of Ser. No. 310,488, Sep. 22, 1994, abandoned.

[30] Foreign Application Priority Data

Sep. 22, 1993 [JP] Japan ..... 5-236538

[51] Int. Cl.[6] ..... G03C 1/09

[52] U.S. Cl. ..... 430/600; 430/603; 430/607; 430/611

[58] Field of Search ..... 430/603, 607, 430/611, 600

[56] References Cited

U.S. PATENT DOCUMENTS

| | | | |
|---|---|---|---|
| 4,914,002 | 4/1990 | Inoue et al. | 430/603 |
| 5,306,613 | 4/1994 | Yagihara et al. | 430/603 |
| 5,342,750 | 8/1994 | Sasaki et al. | 430/603 |

FOREIGN PATENT DOCUMENTS

| | | | |
|---|---|---|---|
| 4271341 | 9/1992 | Japan | 430/603 |

*Primary Examiner*—Janet C. Baxter

*Attorney, Agent, or Firm*—Sughrue, Mion, Zinn, Macpeak & Seas

[57] ABSTRACT

A silver halide photographic material comprises a silver halide emulsion layer provided on a support. The silver halide emulsion layer contains a selenium compound represented by the formula (I), (IIa) or (IIb):

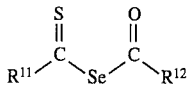

(I)

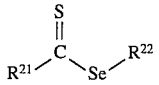

(IIa)

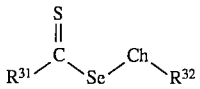

(IIb)

in which each of $R^{11}$ and $R^{12}$ is hydrogen, an aliphatic group, an aromatic group, a heterocyclic group, $—OR^{13}$ or $—NR^{14}R^{15}$; each of $R^{21}$ and $R^{31}$ is an aliphatic group, an aromatic group, a heterocyclic group, $—OR^{23}$ or $—NR^{24}R^{25}$; each of $R^{22}$ and $R^{32}$ is an aliphatic group, an aromatic group or a heterocyclic group; each of $R^{13}$, $R^{14}$, $R^{15}$, $R^{23}$, $R^{24}$ and $R^{25}$ is hydrogen, an aliphatic group, an aromatic group or a heterocyclic group; and Ch is S, Se or Te.

21 Claims, No Drawings

SILVER HALIDE PHOTOGRAPHIC MATERIAL CONTAINING SELENIUM COMPOUND

This is a continuation of application Ser. No. 08/310,488 filed Sep. 22, 1994, now abandoned.

FIELD OF THE INVENTION

The present invention relates to a silver halide photographic material. The invention more particularly relates to a silver halide photographic material containing a new selenium compound in a silver halide emulsion layer.

BACKGROUND OF THE INVENTION

A photographic material comprises a silver halide emulsion provided on a support. The silver halide emulsion is usually chemically sensitized with various chemical sensitizers to obtain a desired sensitivity or gradation. Examples of the chemical sensitizers include a chalcogen (sulfur, selenium or tellurium) sensitizer, a noble metal (such as gold) sensitizer, a reduction sensitizer and a combination thereof.

An improvement of the silver halide photographic material has increasingly been demanded for several years. The recent photographic material requires very high sensitivity. Further, the photographic image requires an improvement of the graininess and the sharpness. A rapid image forming process such as a quick development process is also necessary. The sensitization and the sensitizers have been improved to meet these requirements.

Sulfur sensitization has most frequently been used in silver halide photography. Numerous sulfur sensitizers have been known and used in silver halide photographic materials.

On the other hand, selenium sensitization is more effective than the sulfur sensitization. Accordingly, selenium sensitizers have been proposed in place of the sulfur sensitizers. For example, U.S. Pat. No. 3,297,447 discloses selenium sensitization and selenium sensitizers. However, the proposed selenium sensitizers have a tendency that fogging easily occurs in the image and gradation of the image is softened. Therefore, the selenium sensitizers should be further improved to be used in place of the conventional sulfur sensitizers.

The above-mentioned chalcogen sensitization is usually used in combination with a gold sensitization. The combinations of the sensitizations remarkably improve the sensitivity of the photographic material. However, the combinations also increase the degree of fog in the image. The fog in gold-selenium sensitization is more remarkable than that in gold-sulfur sensitization. Accordingly, the fog caused by a selenium sensitizer should be reduced, particularly in the case that the selenium sensitizer is used in combination with a gold sensitizer.

Japanese Patent Provisional Publication No. 4(1992)-271341 (having no foreign equivalent) discloses an improved chalcogen sensitizer, which is represented by the following formula.

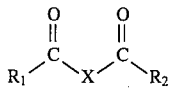

in which each of $R_1$ and $R_2$ is an aliphatic group, an aromatic group, a heterocyclic group; and X is Se or Te.

Japanese Patent Provisional Publication No. 5(1993)-11385 (having no foreign equivalent) discloses another improved selenium sensitizer, which is represented by the following formula.

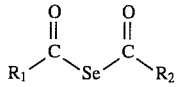

in which $R_1$ an aliphatic group, an aromatic group, a heterocyclic group, $—OR_3$ or $—NR_4R_5$; $R_2$ is $—OR_3$ or $—NR_4R_5$; each of $R_3$, $R_4$ and $R_5$ is hydrogen, an aliphatic group or an aromatic group.

Silver halide photographic materials containing the above-mentioned improved sensitizers have a relatively high sensitivity. Further, the materials are almost free from fog. However, the improvement is still insufficient. The silver halide photographic material now requires a further improved chalcogen sensitizer.

SUMMARY OF THE INVENTION

An object of the present invention is to provide a silver halide photographic material of high sensitivity, which is substantially free from fog.

The present invention provides a silver halide photographic material comprising a silver halide emulsion layer provided on a support, wherein the silver halide emulsion layer contains a selenium compound represented by the formula (I), (IIa) or (IIb):

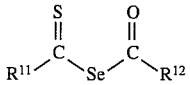

(I)

in which each of $R^{11}$ and $R^{12}$ independently is hydrogen, an aliphatic group, an aromatic group, a heterocyclic group, $—OR^{13}$ or $—NR_{14}R_{15}$; each of $R^{13}$, $R^{14}$ and $R^{15}$ independently is hydrogen, an aliphatic group, an aromatic group or a heterocyclic group; and each of $R^{11}$, $R^{12}$, $R^{13}$, $R^{14}$ and $R^{15}$ may have one or more substituent groups.

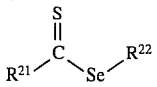

(IIa)

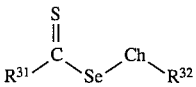

(IIb)

in which each of $R^{21}$ and $R^{31}$ is an aliphatic group, an aromatic group, a heterocyclic group, $—OR^{23}$ or $—NR^{24}R^{25}$; each of $R^{22}$ and $R^{32}$ is an aliphatic group, an aromatic group or a heterocyclic group; each of $R^{23}$, $R^{24}$ and $R^{25}$ independently is hydrogen, an aliphatic group, an aromatic group or a heterocyclic group; each of $R^{21}$, $R^{22}$, $R^{31}$, $R^{32}$, $R^{23}$, $R^{24}$ and $R^{25}$ may have one or more substituent groups; and Ch is S, Se or Te.

The present invention also provides a silver halide photographic material comprising a silver halide emulsion layer provided on a support, wherein the silver halide emulsion is sensitized with a selenium compound represented by the above-mentioned formulas.

The silver halide photographic material of the present invention contains a new selenium compound represented by the above-mentioned formulas. The new compounds have a sufficient sensitizing effect, but do not increase the fog in the image. Therefore, the silver halide photographic material of the invention shows a high sensitivity, while the obtained image is substantially free from fog.

DETAILED DESCRIPTION OF THE INVENTION

The formulas of the selenium compounds are described below.

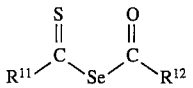

(I)

Each of $R^{11}$ and $R^{12}$ independently is hydrogen, an aliphatic group, an aromatic group, a heterocyclic group, —$OR^{13}$ or —$NR^{14}R^{15}$. Each of $R^{13}$, $R^{14}$ and $R^{15}$ independently is hydrogen, an aliphatic group, an aromatic group or a heterocyclic group. In the formula (I), $R^{11}$ most preferably is —$NR^{14}R^{15}$. In other words, the selenium compound is most preferably represented by the formula (Ia).

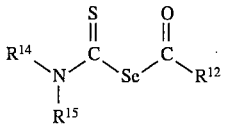

(Ia)

in which $R^{11}$, $R^{14}$ and $R^{15}$ have the same meanings as is defined in the formula (I).

In the formula (I), $R^{12}$ preferably is an aliphatic group, an aromatic group, a heterocyclic group, —$OR^{13}$ or —$NR^{14}R^{15}$. $R^{12}$ most preferably is an aromatic group.

In the formula (I), $R^{13}$ preferably is an aliphatic group or an aromatic group.

In the formula (I), $R^{14}$ most preferably is hydrogen.

In the formula (I), $R^{15}$ preferably is an aliphatic group or an aromatic group.

The above-mentioned aliphatic groups include an alkyl group, an alkenyl group, an alkynyl group and an aralkyl group. The aliphatic group may have any of straight, branched and cyclic structures.

The alkyl group preferably has 1 to 30 carbon atoms, and more preferably has 1 to 20 carbon atoms. Examples of the alkyl groups include methyl, ethyl, n-propyl, isopropyl, t-butyl, n-octyl, n-decyl, n-hexadecyl, cyclopropyl, cyclopentyl and cyclohexyl.

The alkenyl group preferably has 2 to 30 carbon atoms, and more preferably has 2 to 20 carbon atoms. Examples of the alkenyl groups include allyl, 2-butenyl and 3-pentenyl.

The alkynyl group preferably has 2 to 30 carbon atoms, and more preferably has 2 to 20 carbon atoms. Examples of the alkynyl groups include propargyl and 3-pentynyl.

The aralkyl group preferably has 7 to 30 carbon atoms, and more preferably has 7 to 20 carbon atoms. Examples of the aralkyl groups include benzyl and phenethyl.

The above-mentioned aromatic group means an aryl group.

The aryl group preferably has 6 to 30 carbon atoms, and more preferably has 6 to 20 carbon atoms. Examples of the aryl groups include phenyl and naphthyl.

The above-mentioned heterocyclic group preferably has a three-membered to ten-membered heterocyclic ring, and more preferably has a five-membered or six-membered ring. The heterocyclic group preferably has an aromaticity. At least one hetero atom contained in the ring preferably is nitrogen, oxygen or sulfur. The heterocyclic ring may be either saturated or unsaturated. The heterocyclic ring may be condensed with another heterocyclic ring or an aromatic ring. Examples of the heterocyclic groups include pyridyl, imidazolyl, quinolyl, benzimidazolyl, pyrimidyl, pyrazolyl, isoquinolyl, thiazolyl, thienyl, furyl and benzothiazolyl.

Each of $R^{11}$, $R^{12}$, $R^{13}$, $R^{14}$ and $R^{15}$ may have one or more substituent groups. Examples of the substituent groups include a halogen atom (e.g., fluoride, chloride, isopropyl), an alkyl group (methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (benzyl, phenethyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), amino, a substituted amino group (e.g., dimethylamino, ethylamino, anilino), an amido group (e.g., acetamido, benzamido), ureido, a substituted ureido group (e.g., N-methylureido, N-phenylureido), an alkoxycarbonylamino group (e.g., methoxycarbonylamino), an aryloxycarbonylamino group (e.g., phenoxycarbonylamino), a sulfonamido group (e.g., methanesulfoamido, benzenesulfonamido), sulfamoyl, a substituted sulfamoyl group (e.g., N,N-dimethylsulfamoyl, N,N-diethylsulfamoyl, N-phenylsulfamoyl), carbamoyl, a substituted carbamoyl group (e.g., N,N-diethylcarbamoyl, N-phenylcarbamoyl), an aliphatic sulfonyl group (e.g., mesyl), an aromatic sulfonyl group (e.g., tosyl), an aliphatic sulfinyl group (e.g., methanesulfinyl), an aromatic sulfinyl group (e.g., benzenesulfinyl), an alkoxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric amido (e.g., N,N-diethyl phosphoric amido), an arylthio group (e.g., phenylthio), cyano, sulfo, carboxyl, hydroxyl, mercapto, phosphono, nitro, sulfino, ammonio, a substituted ammonio group (e.g., trimethylammonio), phosphonio, hydrazino and a silyl group (e.g., trimethylsilyl, triethylsilyl, t-butyldimethylsilyl, t-butyldiphenylsilyl). Two or more substituent groups may be different from each other. The substituent groups may be further substituted with another group.

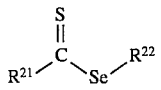

(IIa)

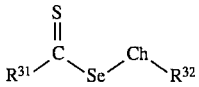

(IIb)

Each of $R^{21}$ and $R^{31}$ is an aliphatic group, an aromatic group, a heterocyclic group, —$OR^{23}$ or —$NR^{24}R^{25}$. Each of $R^{22}$ and $R^{32}$ is an aliphatic group, an aromatic group or a heterocyclic group. Each of $R^{23}$, $R^{24}$ and $R^{25}$ independently is hydrogen, an aliphatic group, an aromatic group or a heterocyclic group. Ch is S, Se or Te.

In the formula (IIa) or (IIb), each of $R^{21}$ and $R^{31}$ preferably is an aromatic group or —$NR^{24}R^{25}$.

In the formula (IIa) or (IIb), each of $R^{22}$ and $R^{32}$ preferably is an aliphatic group or an aromatic group.

In the formula (IIb), Ch preferably is Se.

The definitions of the aliphatic group, the aromatic group and the heterocyclic group are the same as those described in the formulas (I).

Each of $R^{21}$, $R^{22}$, $R^{31}$, $R^{32}$, $R^{23}$, $R^{24}$ and $R^{25}$ may have one or more substituent groups. The definitions of the substituent groups are the same as those described in the formulas (I).

Examples of the selenium compounds of the present invention are shown below.

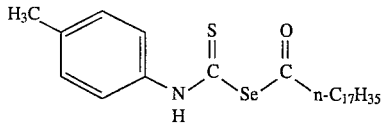
(I-1)

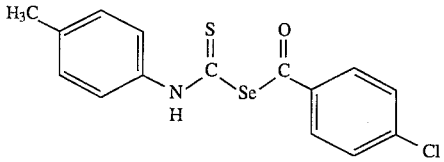
(I-2)

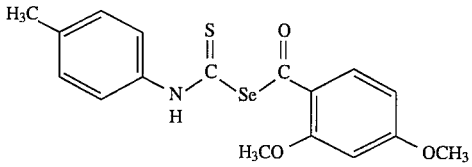
(I-3)

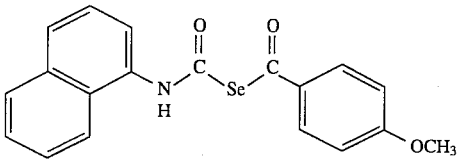
(I-4)

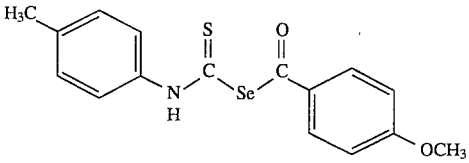
(I-5)

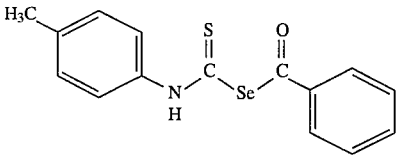
(I-6)

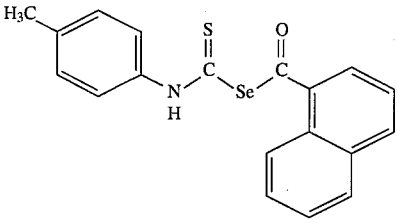
(I-7)

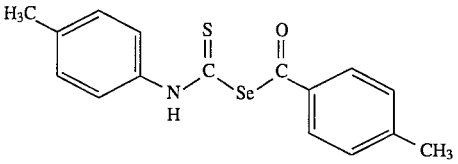
(I-8)

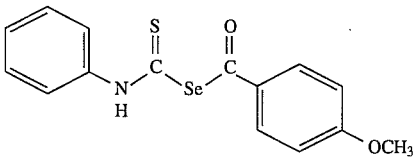
(I-9)

-continued

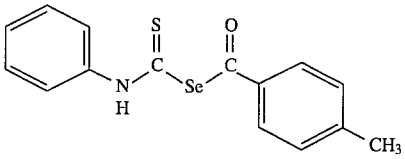
(I-10)

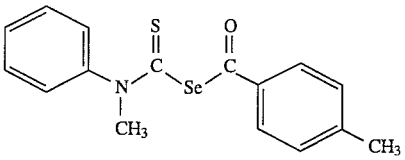
(I-11)

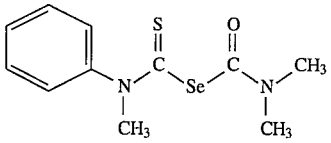
(I-12)

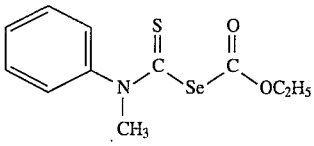
(I-13)

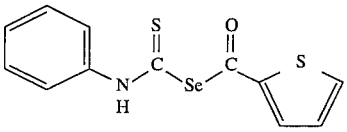
(I-14)

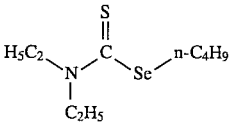
(IIa-1)

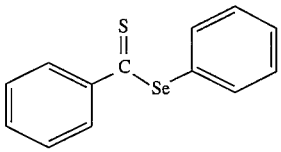
(IIa-2)

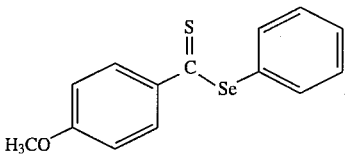
(IIa-3)

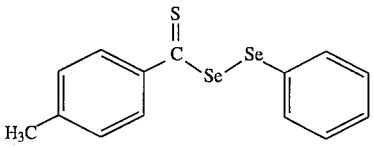
(IIb-1)

A synthesis example is shown below. The other selenium compounds can also be synthesized in a similar manner.

SYNTHESIS EXAMPLE 1

Synthesis of compound (I-5)

In atmosphere of argon at 0° C., 1.6 g (9.5 mmol) of p-methoxybenzoyl chloride was added to a suspension of 1.2 g of sodium selenido ($Na_2Se$) in 30 ml of dry tetrahydrofuran. The mixture was stirred at room temperature for 2 hours. To the obtained brown suspension, 9.5 ml of diethyl ether solution (1 mol per 1) of hydrogen chloride (HCl) was added at 0° C. A precipitate was filtered out in atmosphere of argon to obtain a red solution. To the solution, 1.4 g (9.5 mmol) of p-tolyl isothiocyanate was added at 0° C. The mixture was stirred at room temperature for 3 hours. The formed crystals were filtered off. Thus, 1.4 g of yellow crystals were obtained. The crystals were recrystallized from 10 ml of THF. The subject selenium compound (I- 5) was obtained as needle-like yellow crystals. The yield was 1.2 g (35%). The melting point was 88° to 89° C. The subject compound was confirmed by a nuclear magnetic resonance spectrum, a mass spectrum, an infrared adsorption spectrum and an elemental analysis.

The reactions in the synthesis of the selenium compounds are described in S. Patai, Z. Rappoport, The Chemistry of Organic Selenium and Tellurium compounds, volume 1 (1986) and volume 2 (1987); D. Liotta, Organoselenium Chemistry (1987); C. Paulmier, Selenium Reagents and Intermediates in Organic Synthesis (1986); K. C. Nicolaou, N. A. Patasis, Selenium in Natural Product Synthesis (1984); Acc. Chem. Res., volume 2, page 22 (1979); Tetrahedron, volume 34, page 1049 (1978); Synthesis, page 1 (1986); Acc. Chem. Res., volume 18, page 274 (1985); and K. J. Irgolic, The Organic Chemistry of Tellurium (1974).

Two or more selenium compounds of the present invention can be used in combination.

The amount of the selenium compound for chemical sensitization depends on the nature of the compound, the nature of the silver halide grains and the conditions in the chemical sensitization. The amount of the selenium sensitizer is usually in the range of $10^{-8}$ to $10^{-4}$ mol, and preferably in the range of $10^{-7}$ to $10^{-5}$ mol, based on 1 mol of silver halide.

The chemical sensitization using the sensitizer is conducted preferably at a pAg value of 6 to 11, and more preferably at a pAg value of 7 to 10, and most preferably at a pAg value of 7 to 9.5. The sensitization is preferably conducted at a pH of 3 to 10, and more preferably of 4 to 8. The temperature is preferably in the range of 40° to 95° C., and more preferably in the range of 50° to 85° C.

The selenium compounds of the present invention can be used in combination with other known selenium sensitizers. The known selenium sensitizers are disclosed in U.S. Pat. Nos. 1,574,944, 1,602,592, 1,623,499, 3,297,446, 3,297,447, 3,320,069, 3,408,196, 3,408,197, 3,442,653, 3,420,670, 3,531,289, 3,591,385, 3,655,394, 3,772,031, 4,704,349, 4,810,626; French Patent Nos. 2,093,038, 2,093,209; British Patent Nos. 235,211, 255,846, 861,984, 1,121,496; Canadian Patent No. 800,958; Japanese Patent Publication Nos. 52(1977)-34491, 52(1977)-34492, 52(1977)-36009, 52(1977)-38408, 53(1978)-295, 57(1982)-22090; Japanese Patent Provisional Publication Nos. 59(1984)-180536, 59(1984)-181337, 59(1984)-185329, 59(1984)-185330, 59(1984)-187338, 59(1984)-192241, 60(1985)-150046, 60(1985)-151637, 61(1986)-20940, 61(1986)-67845, 61(1986)-246738, 63(1988)-292126; and H. E. Spencer et al, Journal of Photographic Science, Volume 31, pages 158 to 169, 1983.

A sulfur sensitization, a noble metal (e.g., gold) sensitization or a reduction sensitization can be used in combination with the selenium sensitization. In the present invention, a gold sensitization is preferably used in combination with the selenium sensitization.

In the noble metal sensitization, a salt of a noble metal (e.g., gold, platinum, palladium, iridium) is used. A gold compound is preferably used as the noble metal sensitizer. Examples of the gold sensitizers include chloroauric acid, potassium chloroaurate, potassium aurithiocyanate, gold sulfide and gold selenide. The noble metal sensitizer can be used in an amount of $10^{-7}$ to $10^{-2}$ mol based on 1 mol of silver halide.

In the sulfur sensitization, a labile sulfur compound is used. Examples of the sulfur sensitizers include thiosulfates (e.g., hypo), thioureas (e.g., diphenylthiourea, triethylthiourea, allylthiourea) and rhodanines. The sulfur sensitizers can be used in an amount of about $10^{-7}$ to $10^{-2}$ mol based on 1 mol of silver halide.

In the reduction sensitization, a reducing compound is used. Examples of the reducing compounds include stannous chloride, aminoiminomethanesulfinic acid, hydrazine compounds, borane compounds, silane compounds and polyamine compounds.

The selenium sensitization is preferably conducted in the presence of a silver halide solvent. Examples of the silver halide solvents include thiocyanate salts (e.g., potassium thiocyanate), thioethers (e.g., 3,6-dithia-1,8-octanediol), tetra-substituted thiourea compounds (e.g., tetramethylthiourea), thion compounds, mercapto compounds, mesoionic compounds, selenoethers, telluroethers and sulfites. Ammonia, potassium rhodanide, ammonium rhodanide and amine compounds are also available as the silver halide solvent. The thiocyanate salts, the thioethers, the tetrasubstituted thiourea compounds and the thion compounds are preferred. The thiocyanate salts are particularly preferred. The thioethers are described in U.S. Pat. Nos. 3,021,215, 3,271,157, 3,574,628, 3,704,130, 4,276,374 and 4,297,439, Japanese Patent Publication No. 58(1983)-30571, and Japanese Patent Provisional Publication No. 60(1985)-136736. The tetrasubstituted thiourea compounds are described in U.S. Pat. No. 4,221,863 and Japanese Patent Publication No. 59(1984)-11892. The thion compounds are described in Japanese Patent Publication No. 60(1985)-29727, and Japanese Patent Provisional Publication Nos. 53(1978)-144319, 53(1978)-82408 and 55(1980)-77737. The mercapto compounds are described in Japanese Patent Publication No. 63(1988)-29727. The mesoionic compounds are described in Japanese Patent Provisional Publication No. 60(1985)-163042. The selenoethers are described in U.S. Pat. No. 4,782,013. The telluroethers are described in Japanese Patent Provisional Publication No. 2(1990)-118566. The amine compounds are described in Japanese Patent Provisional Publication No. 54(1979)-100717. The silver halide solvent is preferably used in an amount of $10^{-5}$ to $10^{-2}$ mol based on 1 mol of silver halide.

The silver halide emulsion preferably is a silver bromide, silver iodobromide, silver iodochlorobromide, silver chlorobromide or silver chloride emulsion.

The shape of the silver halide grain may be either in the form of a regular crystal such as cube and octahedron or in the form of an irregular crystal such as globular shape and tabular shape. The shape of the grain may be complex of these crystals. A mixture of these crystals is also available. The regular crystal is particularly preferred.

The silver halide grains may have either a homogeneous structure or a heterogeneous structure in which halogen compositions inside and outside are different from each other. A latent image may be mainly formed either on surface of the grain (e.g., a negative emulsion) or inside the grain (e.g., an internal latent image emulsion or a preferred direct reversal emulsion). The latent image is preferably formed on surface of the grain.

The silver halide emulsion preferably is a tabular grain emulsion in which tabular silver halide grains are contained in an amount of 50% or more based on the total projected area of all the grains. The tabular silver halide grains have a thickness of not more than 0.5 μm (preferably not more than 0.3 μm), a diameter of not less than 0.6 μm and a mean aspect ratio of not less than 5. Further, the silver halide emulsion preferably is a monodispersed emulsion, which has such an almost uniform grain size distribution that a statistic coefficient of variation is not more than 20%. The coefficient of variation (S per d) is determined by dividing a standard deviation (S) by a diameter (d), which is determined by approximating the projected area of the grain to a circle. The tabular grain emulsion may be mixed with the monodispersed emulsion.

The silver halide emulsion can be prepared by conventional processes. The processes are described in P. Glafkides, Chimie er Physique Photographique (Paul Montel Co., 1967); G. F. Duffin, Photographic Emulsion Chemistry (Focal Press, 1966); and V. L. Zelikman et al, Making and Coating Photographic Emulsion (Focal Press, 1964).

The previously mentioned silver halide solvent can be used to control the grain growth in formation of the silver halide grains.

A salt can be added to the emulsion at the stage for formation of the silver halide grains or physical ripening thereof. Examples of the salts include a cadmium salt, a zinc salt, a thallium salt, an iridium salt (or its complex salt), a rhodium salt (or its complex salt) and an iron salt (or its complex salt).

A hydrophilic colloid is used as a binder or a protective colloid for the emulsion layer or an intermediate layer of the photographic material of the invention. Gelatin is an advantageous hydrophilic colloid. The other protective colloids such as proteins, saccharide deriratives and synthetic hydrophilic polymers are also available. Examples of the proteins include a gelatin derivative, a graft polymer of gelatin with another polymer, albumin and casein. Examples of the saccharide derivatives include a cellulose derivative (e.g., hydroxyethyl cellulose, carboxymethyl cellulose and cellulose sulfate), sodium alginate and a starch derivative. Examples of the synthetic hydrophilic homopolymers or copolymers include polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and enzyme-processed gelatin. The enzyme-processed gelatin is described in Bull. Soc. Phot. Japan, No. 16, page 30 (1980). A hydrolysis product of gelatin is also available.

The hydrophilic colloidal layer (e.g., silver halide emulsion layer, a backing layer) of the photographic material can contain an inorganic or organic hardening agent. Examples of the hardening agents include a chromium salt, an aldehyde, an N-methylol compound, an active halogen compound, an active vinyl compound, an N-carbamoylpyridinium salt and a haloamidinium salt. Examples of the aldehydes include formaldehyde, glyoxal and glutaraldehyde. An example of the N-methylol compound is dimethylolurea. Examples of the active halogen compounds include 2,4-dichloro-6-hydroxy-1,3,5-triazine and sodium salt thereof. Examples of the active vinyl compounds include 1,3-bisvinylsulfonyl-2-propanol, 1,2-bis(vinylsulfonylacetamide)ethane, bis(vinylsulfonylmethyl)ether and a vinyl polymer having vinylsulfonyl group on its side chain. An example of the N-carbamoylpyridinium salt is 1-morpholinocarbonyl-3-pyridinio)methanesulfonate. An example of the haloamidinium salt is 1-(1-chloro-1-pyrizino-methylene)pyrrolizinium 2-naphthalenesulfonate.

The active halogen compound, the active vinyl compound, the N-carbamoylpyridinium salt and the haloamidinium salt are preferred because they quickly harden the layers. The active halogen compound and the active vinyl compound are particularly preferred because they give a stable photographic property to the photographic material.

The silver halide emulsion can be spectrally sensitized with a sensitizing dye. Examples of the sensitizing dyes include a methine dye, a cyanine dye, a merocyanine dye, a complex cyanine dye, a complex merocyanine dye, a holopolar cyanine dye, a hemicyanine dye, a styryl dye and a hemioxonol dye. The cyanine dye, the merocyanine dye and the complex merocyanine dye are particularly preferred. These dyes have a basic heterocyclic ring, which is generally contained in the cyanine dyes. Examples of the ring include a pyrroline ring, an oxazoline ring, a thiazoline ring, a pyrrole ring, an oxazole ring, a thiazole ring, a selenazole ring, an imidazole ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthoxazole ring, a benzthiazole ring, a naphthothiazole ring, a benzserenazole ring, a benzimidazole ring and a quinoline ring. These rings may have a substituent group that is attached to the carbon atom of the rings.

The merocyanine dye or the complex merocyanine dye can contain a five-membered or six-membered heterocyclic ring having a ketomethylene structure. Examples of the heterocyclic rings include pyrazoline-5-one rings, thiohydantoin rings, 2-thiooxazolidine-2,4-dione rings, thiazolidine-2,4-dione rings, rhodanine rings and thiobarbituric acid rings.

Two or more sensitizing dyes can be used in combination. A combination of the sensitizing dyes is often used for supersensitization. In addition to the sensitizing dyes, a supersensitizer can be contained in the silver halide emulsion. The supersensitizer itself does not exhibit a spectral sensitization effect or does not substantially absorb visible light, but shows a supersensitizing activity. Examples of the supersensitizer include an aminostilbene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostilbene compound is described in U.S. Pat. Nos. 2,933,390 and 3,635,721. The condensate of an aromatic organic acid and formaldehyde is described in U.S. Pat. No. 3,743,510. The combinations of the supersensitizers are described in U.S. Pat. Nos. 3,615,613, 3,615,641, 3,617,295 and No. 3,635,721.

The silver halide emulsion may contain an antifogging agent or a stabilizer. The antifogging agent prevents occurrence of a fog. The stabilizer has a function of stabilizing the photographic property. The antifogging agent and the stabilizer are used in preparation, storage or processing stage of the photographic material. The antifogging agents and stabilizers are azoles, mercaptopyrimidines, mercaptotriazines, thioketone compounds, azaindenes or amides. Examples of the azoles include benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole). An example of the thioketone compound is oxazolinethione. Examples of the azaindenes include triazaindenes, tetrazaindenes (e.g., 4-hydroxy-substituted (1,3,3a,7)tetrazaindenes) and pentazaindenes. Examples of the amides include benzenethiosulfonic amide, benzenesulfinic amide and benzenesulfonic amide.

The photographic material may contain a surface active agent to improve various properties. For example, a coating property, an antistatic property, a slipping property, an emulsifying or dispersing property, an antitacking property and photographic properties (e.g., development acceleration, high contrast and sensitization) can be improved.

The hydrophilic colloidal layer of the photographic material may contain a water-soluble dye. The water-soluble dye has various functions such as a function of antiirradiation or a function of antihalation as well as a function as a filter dye. Examples of the dyes include an oxonol dye, a hemioxonol dye, a styryl dye, a merocyanine dye, an anthraquinone dye, an azo dye, a cyanine dye, an azomethine dye, a triarylmethane dye and a phthalocyanine dye. Further, an oil-soluble dye can be also added to the hydrophilic colloidal layer by emulsifying the dye in water by a known oil droplet dispersing method.

The photographic material can be used as a multi-layered multicolor photographic material. The multi-layered material comprises a support and two or more silver halide emulsion layers that have different spectral sensitivities.

The multi-layered color photographic material generally comprises at least one red-sensitive emulsion layer, at least one green-sensitive emulsion layer and at least one blue-sensitive emulsion layer on the support. The arrangement of those layers can optionally be determined. Preferably, the red-sensitive layer, the green-sensitive layer and the blue-sensitive layer are arranged from the support in the order. The blue-sensitive layer, the green-sensitive layer and the red-sensitive layer can be arranged in the order from the support. The blue-sensitive layer, the red-sensitive layer and the green-sensitive layer can also be arranged in the order from the support. Further, two or more emulsion layers that are sensitive to the same color but show different sensitivities can be provided to enhance the sensitivity. Three emulsion layers can be provided to improve the graininess of the image. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer, to enhance the sensitivity.

The red-sensitive emulsion layer generally contains a cyan coupler, the green-sensitive emulsion layer generally contains a magenta coupler, and the blue-sensitive emulsion layer generally contains a yellow coupler. However, other combinations are also available. For example, an infrared sensitive layer can be used to prepare a false color film or a film for exposure to a semiconductor laser beam.

Various color couplers can be used for the photographic material of the invention. The color couplers are described in the patents cited in Research Disclosure No. 17643, VII C-G.

Yellow couplers are described in U.S. Pat. Nos. 3,933,501, 4,022,620, 4,326,024 and 4,401,752, Japanese Patent Publication No. 58(1983)-10739, and British Patent No. 1,425,020 and No. 1,476,760.

Preferred magenta couplers are 5-pyrazolone type and pyrazoloazole type compounds. The magenta couplers are described in U.S. Pat. Nos. 4,310,619 and 4,351,897, European Patent No. 73,636, U.S. Pat. Nos. 3,061,432 and 3,725,067, Research Disclosure No. 24220 (June 1984), Japanese Patent Provisional Publication No. 60(1985)-33552, Research Disclosure No. 24230 (June 1984), Japanese Patent Provisional Publication No. 60(1985)-43659, and U.S. Pat. Nos. 4,500,630 and 4,540,654.

Preferred cyan couplers are phenol type and naphthol type couplers. The cyan couplers are described in U.S. Pat. Nos. 2,369,929, 2,772,162, 2,801,171, 2,895,826, 3,446,622, 3,758,308, 3,772,002, 4,052,212, 4,146,396, 4,228,233, 4,296,200, 4,327,173, 4,333,999, 4,334,011, 4,427,767, 4,451,559, German Patent Publication No. 3,329,729, European Patent No. 121,365A and No. 161,626A.

A colored coupler may be used to compensate incidental absorption of a formed dye. The colored couplers are described in Research Disclosure No. 17643, VII-G, U.S. Pat. No. 4,163,670, Japanese Patent Publication No. 57(1982)-39413, U.S. Pat. Nos. 4,004,929 and 4,138,258, and British Patent No. 1,146,368.

The photographic material can contain a coupler that gives a developed color dye having an appropriate diffusion property. Such couplers are described in U.S. Pat. No. 4,366,237. British Patent No. 2,125,570, European Patent No. 96,570 and German Patent Publication No. 3,234,533.

A polymerized dye-forming coupler is also available. The dye-forming couplers are described in U.S. Pat. Nos. 3,451,820, 4,080,211 and 4,367,282, and British Patent No. 2,102,173.

The photographic material can contain a coupler that releases a photographic functional residue according to a coupling reaction. For example, a DIR coupler releases a development inhibitor. The DIR couplers are described in Research Disclosure No. 17643, VII-F, Japanese Patent Provisional Publication Nos. 57(1982)-151944, 57(1982)-154234 and 60(1985)-184248, and U.S. Pat. No. 4,248,962.

The photographic material can also contain a coupler that imagewise releases a nucleating agent or a development accelerator in a development process. Such couplers are described in British Patent Nos. 2,097,140 and 2,131,188, and Japanese Patent Provisional Publication Nos. 59(1984)-157638 and 59(1984)-170840.

Examples of other couplers include a competitive coupler, a polyvalent coupler, a DIR redox compound, a DIR coupler releasing coupler, a dye releasing coupler, a bleach accelerator releasing coupler and a ligand releasing coupler. The competitive coupler is described in U.S. Pat. No. 4,130,427. The polyvalent coupler is described in U.S. Pat. Nos. 4,283,472, 4,338,393 and 4,310,618. The DIR redox compounds and the DIR coupler releasing couplers are described in Japanese Patent Provisional Publication Nos. 60(1985)-185950 and 62(1987)-24252. The dye releasing coupler releases a dye, which is restored to original color. The dye releasing coupler is described in European Patent No. 173,302A. The bleach accelerator releasing coupler is described in Research Disclosure No. 11449, ibid. No. 24241, and Japanese Patent Provisional Publication No. 61(1986)-201247. The ligand releasing coupler is described in U.S. Pat. No. 4,553,477.

The couplers can be introduced into the photographic material by various known dispersing methods. A high-boiling solvent can be used in an oil in water dispersing method. The high-boiling solvents are described in U.S. Pat. No. 2,322,027.

The high-boiling organic solvents usually have a boiling point of not lower than 175° C. under a normal pressure. Examples of the high-boiling organic solvents include phthalic esters, phosphoric esters, phosphonic esters, benzoic esters, amides, alcohols, phenols, aliphatic carboxylic esters, aniline derivatives and hydrocarbons. Examples of the phthalic esters include dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate and bis(1,1-diethylpropyl)phthalate. Examples of the phosphoric esters include triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexyl phosphate. Examples of the benzoic esters include 2-ethylhexyl benzoate, dodecyl benzoate and 2-ethylhexyl-p-hydroxybenzoate. Examples of the amides include N,N-diethyldodecanamide, N,N-diethyllaurylamide and N-tetradecylpyrrolidone. An example of the alcohol is isostearyl alcohol. An example of the phenol is 2,4-di-tert-amylphenol. Examples of the aliphatic carboxylic esters include bis(2-ethylhexyl)sebacate, dioctyl azelate, glycerol tributyrate, isostearyl lactate and trioctyl citrate. An example of the aniline derivative is N,N-dibutyl-2-butoxyl-5-tert-octylaniline. Examples of the hydrocarbons include paraffin, dodecylbenzene and diisopropylnaphthalene.

An organic solvent can be used as an auxiliary solvent in addition to the high-boiling organic solvent. The auxiliary solvent has a boiling point of not lower than about 30° C. The boiling point preferably is in the range of 50° to 160° C. Examples of the auxiliary solvents include ethyl acetate, butyl acetate, ethyl propionate, methyl ethyl ketone, cyclohexanone, 2-ethoxyethyl acetate and dimethylformamide.

A latex dispersing method is available in preparation of the photographic material. A process of the latex dispersing method, effects thereof and examples of latex for impregnation are described in U.S. Pat. No. 4,199,363, German Patent Publication Nos. 2,541,274 and 2,541,230.

There is no specific limitation on the support on which the above-mentioned silver halide emulsion layer is provided. Various flexible and rigid materials can be used as the support. The flexible materials include plastic films, papers and cloths. The rigid materials include glass, ceramics and metals. Preferred examples of the flexible materials include semi-synthetic or synthetic polymers, baryta papers; and other papers coated or laminated with α-olefin polymers. Examples of the semi-synthetic or synthetic polymers include cellulose nitrate, cellulose acetate, cellulose butyl acetate, polystyrene, polyvinyl chloride, polyethylene terephthalate and polycarbonate. Examples of the α-olefin polymers include polyethylene, polypropylene and ethylene-butene copolymer. The support can be colored with dyes or pigments. Further, the support can also be made black for light-blocking. The surface of the support is generally subjected to undercoating treatment to enhance the adhesion with the silver halide emulsion layer. The surface of the support may be further subjected to other various treatments such as glow discharge, corona discharge, irradiation with ultraviolet rays and flame treatment before or after the undercoating treatment.

The silver halide emulsion layer and other hydrophilic colloidal layers can be coated on the support by a known coating method such as dip coating, roller coating, flood coating and extrusion coating. Two or more layers can be simultaneously coated. The simultaneous coating methods are described in U.S. Pat. Nos. 2,681,294, 2,761,791, 3,526,528 and 3,508,947.

The photographic material of the invention can be used as a monochromatic or color photographic material. In more detail, the photographic material is available as a usual or cinematographic color negative film, a color reversal film for slide or television, a color paper, a color positive film, a color reversal paper, a color diffusion. The material is also available as a transfer type photographic material and a heat development type color photographic material. Further, the photographic material is available as a black and white photographic material for X-rays by using a mixture of three color couplers or by using a black coupler. The three color couplers are described in Research Disclosure, No. 17,123, (July 1978). The black coupler is described in U.S. Pat. No. 4,126,461 and British Patent No. 2,102,136. Furthermore, the photographic material is available as a printing film (e.g., lithographic films and scanner films), a medical (direct or indirect) or industrial X-ray film, a picture-taking black and white negative film, a black and white photographic paper or a COM or usual microfilm. Moreover, the material is available as a silver salt diffusion transfer type photographic material or a printing out type photographic material.

The photographic material can be used in a color diffusion transfer process. The color diffusion transfer process can be classified into a peel apart type, an integrated type and a film unit type that does not require peeling. The integrated type is described Japanese Patent Publication Nos. 46(1971)-16356 and 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be advantageously used in the color diffusion transfer photographic material, because the layers have a function of allowing a broad latitude of the processing temperature. The acidic polymer may be added to a developing solution contained in a vessel.

Various exposure means can be employed for exposure of the photographic material of the invention. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, and flash light sources (e.g., electric flash and metal-burning flashbulb).

Light sources that emit light in the ultraviolet to infrared region can be also used as the recording light sources. For example, the photographic material can be exposed to gas lasers, dye solution lasers, semiconductor lasers, light emission diode or plasma light source. The material can be exposed to fluorescent surface given by the stimulated phosphor with electron rays (e.g., CRT). A liquid crystal (LCD) is also available. The photographic material can use an exposure means in a microshutter array is combined with a linear or plane-like light source. The microshutter array may comprise lead zirconate titanate (PLZT) doped with lanthanum. The spectral distribution used in the exposure process can be appropriately adjusted by color filters.

A color developing solution used in the development process of the photographic material according to the invention preferably is an alkaline aqueous solution containing an aromatic primary amine color developing agent as a host component. Aminophenol compounds and p-phenylenediamine compounds are preferably used as the color developing agent. Examples of the p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline and 3-methyl-4-amino-N-ethyl-N-β-methoxyethylaniline. Sulfates, hydrochlorides and p-toluenesulfonates of those compounds are also available. Salts of diamines are generally preferred to free diamines because the salts are more stable than the free diamines.

The color developing solution generally contains pH buffering agents (e.g., alkali metal carbonates, borates and phosphates), development inhibitors (e.g., bromides, iodides, benzimidazoles, benzothiazoles, mercapto compounds) and antifogging agents. The developing solution may further contain preservatives (e.g., hydroxylamine, sulfite), organic solvents (e.g., triethanol amine, diethylene glycol), development accelerators (e.g., benzyl alcohol, polyethylene glycol, quarternary ammonium salts, amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid, phosphonocarboxylic acid) and antioxidants. The antioxidants are described in German Patent Publication No. 2,622,950.

In the development process of color reversal photographic materials, a color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). The monochromatic developing agents can be employed singly or in combination.

The silver halide emulsion layer is generally subjected to bleaching process after the color development process. The bleaching process can be conducted simultaneously with or separately from a fixing process. For the rapid processing, a bleach-fix process can be conducted after the bleaching process. Bleaching solutions usually contain polyvalent metals such as iron(III), cobalt(III), chromium(IV) and copper(II), peracids, quinones and nitroso compounds. Examples of the bleaching agents include ferricyanides; dichromates; organic complex salts of iron(III) or cobalt(III), persulfates, manganates and nitrosophenol. Examples of the organic complex salts of iron(III) or cobalt(III) include complex salts thereof with aminopolycarboxylic acids and complex salts thereof with organic acids. Examples of the aminopolycarboxylic acids include ethylenediaminetetraacetic acid, diethylenetriaminepentaacetic acid, nitrilotriacetic acid and 1,3-diamino-2-propanoltetraacetic acid. Examples of the organic acids include citric acid, tartaric acid and malic acid. Ethylenediaminetetraacetic acid iron(III) salt, diethylenetriaminepentaacetic acid iron(III) salt and persulfate are preferred from the viewpoints of rapid processing and prevention of environmental pollution. Particularly, the ethylenediaminetetraacetic acid iron(III) complex salt is preferably used in a bleaching solution (in bleaching bath) or a bleach-fix solution.

A bleaching accelerator can be optionally used in the bleaching bath, the bleach-fix bath or the prior bath to those baths. Examples of the bleaching accelerators include mercapto or disulfide compounds, thiazolidine derivatives, thiourea derivatives, iodides, polyethylene oxides and polyamine compounds. The mercapto and disulfide compounds are described in U.S. Pat. No. 3,893,858, German Patent Nos. 1,290,812, 2,059,988, Japanese Patent Provisional Publication Nos. 53(1978)-32736, 53(1978)-57831, 53(1978)-37418, 53(1978)-65732, 53(1978)-72623, 53(1978)-95630, 53(1978)-95631, 53(1978)-104232, 53(1978)-124424, 53(1978)-141623, 53(1978)-28426, and Research Disclosure No. 17129 (July 1978). The thiazolidine derivatives are described in Japanese Patent Provisional Publication No. 50(1975)-140129. The thiourea derivatives are described in Japanese Patent Publication No. 45(1970)-8506, Japanese Patent Provisional Publication Nos. 52(1977)-20832, 53(1978)-32735 and U.S. Pat. No. 3,706,561. The iodides are described in German Patent No. 1,127,715 and Japanese Patent Provisional Publication No. 58(1983)-16235. The polyethylene oxides are described in German Patent Nos. 966,410 and 2,748,430. The polyamine compounds are described in Japanese Patent Publication No. 45(1970)-8836. Other bleaching accelerators are described in Japanese patent Provisional Publication Nos. 49(1974)-42434, 49(1974)-59644, 53(1978)-94927, 54(1979)35727, 55(1980)-26506 and 58(1983)-163940. Additionally, iodide ion and bromide ion can also be available as the bleaching accelerator. The bleaching accelerators preferably are mercapto or disulfide compounds because the compounds show high acceleration effects. The preferred compounds are described in U.S. Pat. Nos. 3,893,858, 4,552,834, German Patent Publication No. 1,290,812 and Japanese Patent Provisional Publication No. 53(1978)-95630. The bleaching accelerators may be contained in the photographic material. The bleaching accelerators are particularly effective in the bleach-fix process of color photographic materials for picture-taking.

Examples of fixing agents include thiosulfates, thiocyanates, thioether compounds, thioureas, and iodides. When iodides are used as the fixing agents, they are used in a large amount. Of the above-mentioned compounds, thiosulfates are generally used. A preservative can be used in the bleach-fix solution or the fixing solution. Examples of the preservatives include sulfites, bisulfites and carbonylbisulfurous acid addition products.

After the bleach-fix process or the fixing process, the photographic material is generally subjected to washing and stabilization. In the washing stage or the stabilization stage, a variety of known compounds can be used for preventing precipitation and saving water. For example, a hard water softening agent can be used to prevent precipitation. Examples of the agents include inorganic phosphoric acids, aminopolycarboxylic acids, organic aminopolyphosphoric acids and organic phosphoric acids. The washing or stabilizing solution may further contain germicides, mildewcides or metal salts (e.g., magnesium salts, aluminum salts and bismuth salts) to prevent various bacteria, alga and mildew. A surface active agent is also available for preventing drying strain or drying mark. Further, various hardeners for film-hardening can be used in the solution. Moreover, compounds described in L. E. West, Photographic Science And Engineering, Vol. 6, pages 344 to 359, (1955) can be also employed. Chelating agents and mildewcides are particularly preferred.

In the washing process, countercurrent washing using two or more baths is generally employed to save water. Instead of the washing process, a multi-stage countercurrent stabilizing process as described in Japanese Patent Provisional Publication No. 57(1982)-8543 can be used, and in this process, 2 to 9 countercurrent baths are required. The stabilizing baths may further contain various compounds to stabilize resulting images. For example, various buffering agents for adjusting pH value of the resulting films (for example, adjusting to pH of 3 to 9), and aldehydes (e.g., formalin) may be added. Concrete examples of the buffering agents include borates, metaborates, borax, phosphates, carbonates, potassium hydroxide, sodium hydroxide, ammonia water, monocarboxylic acids, dicarboxylic acids and polycarboxylic acids. They may be used in combination. Further, other additives are available. Examples of the other additives include chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, isothiazolone, 4-thiazolinebenzimidazole, halogenated phenol, sulfanilamide and benzotriazole), surface active agents, brightening agents and hardeners. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the processing conditions. The time generally is in the range of 20 seconds to 10 minutes, preferably in the range of 20 seconds to 5 minutes.

The silver halide color photographic material can contain a color developing agent for simple and rapid processing. Precursors of the color developing agents are preferably used to be contained in the photographic material. Examples of the precursors include indolenine compounds, Schiff's base type compounds, aldol compounds, metal complex salts, urethane compounds, and other salt type precursors. The indolenine compounds are described in U.S. Pat. No. 3,342,597. The Schiff's base type compounds are described in U.S. Pat. No. 3,342,599 and Research Disclosure, Nos. 14,850 and 15,159. The aldol compounds are described in Research Disclosure, No. 13,924. The metal complex salts are described in U.S. Pat. No. 3,719,492. The urethane compounds are described in Japanese Patent Provisional Publication No. 53(1978)-135628. The other salt type precursors are described in Japanese Patent Provisional Publication Nos. 56(1981)-6235, 56(1981)-16133, 56(1981)-59232, 56(1981)-67842, 56(1981)-83734, 56(1981)-83735, 56(1981)-83736, 56(1981)-89735, 56(1981)-81837, 56(1981)-54430, 56(1981)-106241, 54(1979)-107236, 57 (1982)-97531 and 57 (1082)-83565.

The silver halide color photographic material may contain 1-phenyl-3-pyrazolidones to accelerate color development. The 1-phenyl-3-pyrazolidones are described in Japanese Patent Provisional Publication Nos. 56(1981)-64339, 57(1982)-144547, 57(1982)-211147, 58(1983)-50532, 58(1983)-50533, 58(1983)-50534, 58(1983)-50535, 58(1983)-50536 and 58(1083)-115438.

The processing solutions are used at a temperature of 10° to 50° C. The temperature generally is in the range of 33° to 38° C. However, the temperature can be adjusted higher to accelerate the processing or to shorten the processing time. On the other hand, it can be adjusted lower to improve qualities of the resulting images or to enhance the stability of the solutions. Cobalt intensification or hydrogen peroxide intensification can be used to save the amount of silver. The cobalt intensification is described in German Patent Publication No. 2,226,770. The hydrogen peroxide intensification is described in U.S. Pat. No. 3,674,499.

The above-mentioned various baths may be equipped with a heater, a temperature sensor, a liquid level sensor, a circulating pump, a filter, a floating lid or a squeegee.

In the continuous processing, a replenisher can be used for each processing solution to prevent the solution composition from varying, whereby a uniform finish can be obtained. The replenisher can be used in an amount of not more than half the standard amount to reduce the cost.

When the photographic material is used as a color paper, the above-mentioned bleach-fix process is usually carried out. The photographic material is used as a picture taking color photographic material, the process is optionally carried out.

EXAMPLE 1

At 75° C., 1 liter of an aqueous solution containing 0.05 g of potassium bromide and 30 g of gelatin was prepared and adjusted to pH 2 using nitric acid. To the gelatin solution, 75 ml of an aqueous solution (1M) of silver nitrate and an aqueous solution (1M) of potassium bromide were simultaneously added while stirring over 4 minutes. The silver potential was kept at 0 mV to saturation calomel electrode.

To the resulting mixture, 675 ml of an aqueous solution (1M) of silver nitrate and an aqueous solution (1M) of potassium bromide were added over 30 minutes while keeping the silver potential at −30 mV.

After the grain formation, the resulting emulsion was desalted according to a flocculation method using a conventional polymer flocculating agent, and was washed with water. Then, gelatin and water were added to the emulsion. The emulsion was adjusted to pH 6.4 and pAg 8.6.

The obtained silver bromide emulsion is a monodispersed octahedral silver bromide emulsion having a mean grain diameter of 0.21 μm and a distribution coefficient of the grain diameter of 9.5%.

The obtained emulsion was divided into small parts, and each part was heated to 60° C. The compounds set forth in Table 1 was added to each parts. The chemical sensitization was carried out for 60 minutes.

To each part were further added 3-{3-[2-(2,4-di-tertamylphenoxy)butylylamino]benzoylamino}-1-(2,4,6-trichlorophenyl)pyrazolone-5-one (magenta coupler), tricresyl phosphate, 4-hydroxy-6-methyl-1,3,3a,7-tetraazaindene, sodium dodecylbenzenesulfonate and 1,2-bis(vinylsulfonylacetylamino)ethane to prepare a coating solution.

The coating solution and a gelatin solution for a protective layer containing polymethyl methacrylate particles were simultaneously coated on a cellulose triacetate film support according to an extrusion method.

Each of the prepared samples was exposed to light through an optical wedge for 10 seconds, and was subjected to a developing process.

The developing process was carried out at 38° C. under the following conditions.

| Process | Period (second) | Temperature |
|---|---|---|
| Color development | 165 | 38° C. |
| Bleaching | 180 | 38° C. |
| Washing | 30 | 24° C. |
| Fixing | 180 | 38° C. |
| Washing (1) | 30 | 24° C. |
| Washing (2) | 30 | 24° C. |
| Stabilizing | 30 | 38° C. |
| Drying | 260 | 55° C. |

The compositions of the processing solutions are shown below.

| | |
|---|---|
| Color developing solution | |
| Diethylenetriaminepentaacetic acid | 1.0 g |
| 1-Hydroxyethylidene-1,1-diphosphonic acid | 3.0 g |
| Sodium sulfite | 4.0 g |
| Sodium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make up to | 1.0 l |
| pH | 10.05 |
| Bleaching solution | |
| Iron(III) sodium ethylenediaminetetraacetate trihydrate | 100.0 g |
| Disodium ethylenediaminetetraacetate | 10.0 g |
| 3-Mercapto-1,2,4-triazole | 0.08 g |
| Ammonium bromide | 140.0 g |
| Ammonium nitrate | 30.0 g |
| Ammonia water (28%) | 6.5 ml |
| Water to make up to | 1.0 l |
| pH | 6.0 |
| Fixing solution | |
| Disodium ethylenediaminetetraacetate | 0.5 g |
| Ammonium sulfite | 20.0 g |
| Aqueous solution of ammonium thiosulfate (700 g/l) | 290.0 ml |
| Water to make up to | 1.0 l |
| pH | 6.7 |
| Stabilizing solution | |
| Sodium p-toluenesulfinate | 0.03 g |
| Polyoxyethylene-p-monononylphenyl ether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-l-ylmethyl)piperazine | 0.75 g |
| Water to make up to | 1.0 l |
| pH | 8.5 |

The densities of the processed samples were measured through a green filter. The results on the photographic properties are set forth in Table 1.

In Table 1, the sensitivity is expressed by a relative reciprocal value of the exposure required to obtain an optical density of the fogging value plus 0.2. The relative value is defined in the manner that the value of the sample No. 1 is 100.

Further, the amount of the compound means an amount by mol based on 1 mol of silver halide. The amounts set forth in Table 1 mean the optimum amounts of the compounds, which were determined by preliminary experiments. Accordingly, the experiments were conducted based on a policy that the best results of the present invention were compared with the best results of the comparative samples.

TABLE 1

| Sample No. | Compound No. | Compound Amount | Fog | Sensitivity |
|---|---|---|---|---|
| 1 | A | $1.6 \times 10^{-5}$ | 0.21 | 100 |
| 2 | B | $3.2 \times 10^{-5}$ | 0.04 | 71 |
| 3 | I-2 | $2.3 \times 10^{-5}$ | 0.10 | 108 |
| 4 | I-4 | $1.2 \times 10^{-5}$ | 0.11 | 110 |
| 5 | I-5 | $1.6 \times 10^{-5}$ | 0.07 | 116 |
| 6 | I-7 | $1.2 \times 10^{-5}$ | 0.06 | 98 |
| 7 | C | $2.3 \times 10^{-5}$ | 0.18 | 98 |
| 8 | D | $1.6 \times 10^{-5}$ | 0.17 | 98 |

Remark: A: N,N-dimethylselenourea (Disclosed in U.S. Pat. No. 3,297,447)

B: Sodium thiosulfate (sulfur sensitizer)

C:

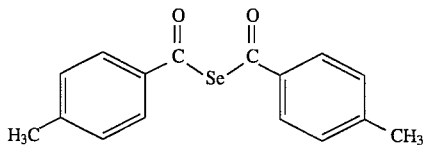

(Disclosed in Japanese Patent Provisional Publication No. 4(1992)-271341)

D:

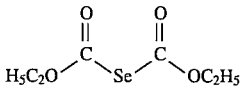

(Disclosed in Japanese Patent Provisional Publication No. 5(1993)-11385)

As is evident from the results set forth in Table 1, the selenium sensitizers of the invention reduce the occurrence of fog, compared with the conventional sensitizers. On the other hand, the sensitivity of the sample of the invention was almost equal to or higher than that of the comparative samples.

EXAMPLE 2

Preparation of tabular silver halide emulsion

In 11 of water, 6 g of potassium bromide and 7 g of low molecular gelatin (average molecular weight: 15,000) were dissolved. The solution was placed in a vessel, and was kept at 55° C. To the vessel, 37 cc of aqueous silver nitrate solution (silver nitrate content: 4.00 g) and 38 cc of aqueous potassium bromide solution (potassium bromide content; 5.9 g) were added for 37 seconds according to a double jet method while stirring. After 18.6 g of gelatin was added to the vessel, the mixture was heated to 70° C. Further, 89 cc of aqueous silver nitrate solution (silver nitrate content: 9.8 g) was added to the mixture for 22 minutes. Furthermore, 7 cc of 25% ammonia water was added to the mixture. The resulting mixture was left at the same temperature for 10 minutes for physical ripening. To the obtained emulsion, 6.5 cc of 100% acetic acid was added. To the mixture, an aqueous silver nitrate solution (silver nitrate content: 153 g) and an aqueous potassium bromide solution (potassium bromide content: 107 g) was added for 35 minutes according to a controlled double jet method while keeping pAg of 8.5. Further, 15 cc of 2N potassium thiocyanate was added to the emulsion. The emulsion was kept at the same temperature for 5 minutes for physical ripening. The emulsion was then cooled to 35° C. Thus a monodispersed tabular pure silver bromide emulsion was obtained. The average diameter (based on the projected area) was 1.10 μm, the thickness was 0.145 μm, and the distribution coefficient of the diameter was 18.5%.

The soluble salts were removed from the emulsion according to a flocculation method. After the emulsion was heated to 40° C., 10 g of gelatin, 2.35 g of phenoxyethanol and 0.8 g of sodium polystyrenesulfonate were added to the emulsion. The emulsion was adjusted to pH 5.90 and pAg 8.00 using sodium hydroxide and silver nitrate solution.

The emulsion was subjected to chemical sensitization while stirring at 56° C. First, a thiosulfonate compound ($C_2H_5SO_2SNa$) was added to the emulsion (amount: $1\times10^{-5}$ mol per 1 mol of silver). Then, fine silver iodide grains were added to the emulsion (amount: 0.1 mol %). Further, 0.043 mg of aminoiminomethanesulfinic acid was added to the emulsion. The emulsion was left for 22 minutes for reduction sensitization. To the emulsion, 20 mg of 4-hydroxy-6-methyl-1,3,3a,7-tetrazaindene and 400 mg of the following sensitizing dye I were added.

(Sensitizing dye I)

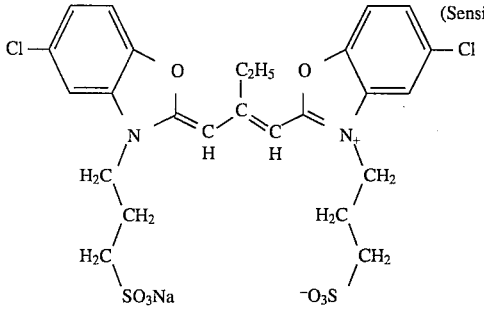

Further, 0.83 g of calcium chloride was added to the emulsion. Furthermore, 1.3 mg of sodium thiosulfate, the compounds set forth in Table 2, 2.6 mg of chloroauric acid and 90 mg of potassium thiocyanate were added to the emulsion. After 40 minutes, the emulsions were cooled to 35° C. Thus tabular silver halide emulsions were prepared.

Coating solution for emulsion layer

The following agents were added to the above-prepared silver halide emulsions to prepare coating solutions. The following amounts of the agents (except the hardening agent) mean the amounts based on 1 mol of silver halide.

| Agents for emulsion layer | |
|---|---|
| Gelatin (including gelatin contained in the silver halide emulsion) | 108 g |
| Trimethylolpropane | 9 g |
| Dextran (average molecular weight: 39,000) | 18.5 g |
| Sodium polystyrenesulfonate (average molecular weight: 600,000) | 1.8 g |
| 1,2-Bis(vinylsulfonylacetamido)ethane (hardening agent) | (*) |
| Compound I | 34 mg |
| Compound II | 4.8 g |
| Compound III | 15 mg |

(*) The amount was so adjusted that the swelling ratio is 230%.

-continued

| Agents for emulsion layer |
|---|

(Compound I)

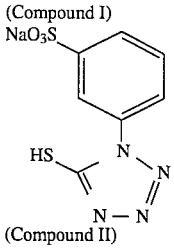

(Compound II)

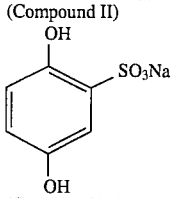

(Compound III)

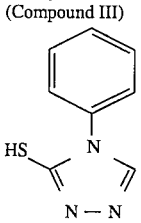

Preparation of dye emulsion

At 60° C., 60 g of the following dye I, 62.8 g of the following high boiling organic solvent I and 62.8 g of the following high boiling organic solvent II were dissolved in 333 g of ethyl acetate.

(Dye I)

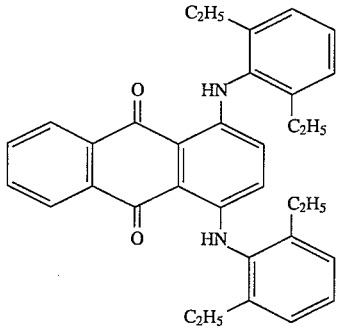

(High boiling organic solvent I)

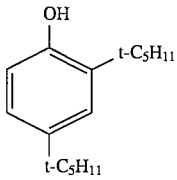

(High boiling organic solvent II)

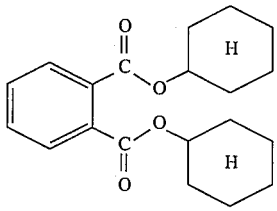

To the solution, 65 cc of 5% aqueous solution of sodium dodecylsulfonate, 94 g of gelatin and 581 cc of water were added. The mixture was emulsified at 60° C. for 30 minutes using a dissolver. Further, 2 g of the following compound IV and 6 l of water were added to the emulsion.

(Compound IV)

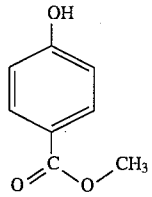

The emulsion was cooled to 40° C. The emulsion was so condensed using a ultrafiltration laboratory module (Asahi Chemical Industry Co., Ltd., ACP1050) that the total amount was 2 kg. Further, 1 g of the compound IV was further added to the emulsion.

The obtained dye emulsion was added to the coating solution in such an amount that the coating amount of the dye I was 10 mg/m$^2$ on one surface.

Coating solution for surface protective layer

The following coating solution was prepared.

| Agents for protective layer | (amount: g/m$^2$) |
|---|---|
| Gelatin | 0.78 |
| Sodium polyacrylate | 0.080 |
| 4-Hydroxy-6-methyl-1,3,3a,7-tetrazaindene | 0.015 |
| Coating aid I | 0.013 |
| Coating aid II | 0.045 |
| Coating aid III | 0.0065 |
| Coating aid IV | 0.003 |
| Coating aid V | 0.001 |
| Compound V | 0.0017 |
| Compound VI | 0.1 |
| Polymethyl methacrylate (average particle size: 3.7 μm) | 0.087 |
| Proquicel (adjusted to pH 7.4 using NaOH) | 0.0005 |

(Coating aid I)

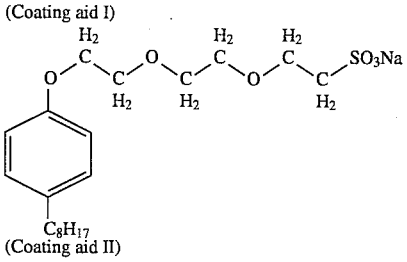

(Coating aid II)

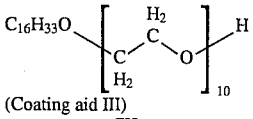

(Coating aid III)

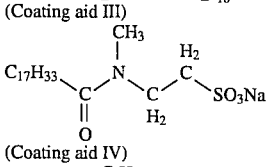

(Coating aid IV)

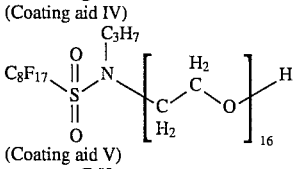

(Coating aid V)

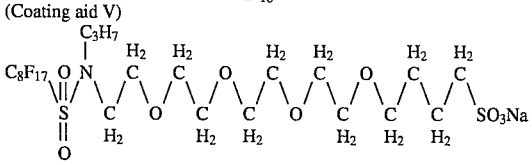

-continued

| Agents for protective layer | (amount: g/m$^2$) |
|---|---|

(Compound V)

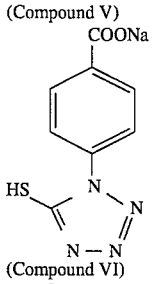

(Compound VI)

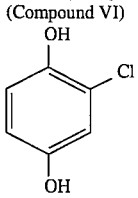

Preparation of dye dispersion

In a ball mill of 2 l, 434 ml of water and 791 ml of 6.7% aqueous solution of a surface active agent (Triton X- 200) were placed. To the solution, 20 g of the following dye was added.

(Dye)

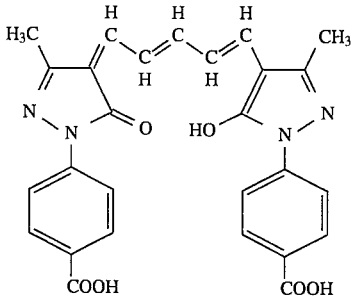

To the solution, 400 ml of beads (diameter: 2 mm) of zirconium dioxide ($ZrO_2$) were added. The mixture was ground for 4 days. To the ground mixture, 160 g of 12.5% aqueous solution of gelatin was added. After the mixture was defoamed, $ZrO_2$ beads were removed by filtration. The obtained dye dispersion has particle sizes in a wide range of 0.05 to 1.15 μm. The average particle size was 0.37 μm.

The dye particles having a particle size of larger than 0.9 μm were removed by centrifugation.

Thus a dye dispersion was prepared.

Formation of support

A biaxially stretched polyethylene terephthalate film (thickness: 175 μm) was treated with corona discharge. The film contained the dye used in the preparation of the dye emulsion. The amount of the dye is 0.04 wt. %. The following coating solution was coated on the film in the coating amount of 4.9 cc/m$^2$ using a wire bar to form a first undercoating layer. The layer was dried at 185° C. for 1 minute.

On the other side of the film, the coating solution was coated to form a first undercoating layer.

| Coating solution for first undercoating layer | |
|---|---|
| Latex* of butadiene-styrene copolymer (solid content: 40%, butadiene/styrene | 158 cc |

-continued

| Coating solution for first undercoating layer | |
|---|---|
| weight ratio: 31/69) | |
| 4% solution of sodium 2,4-dichloro-6-hydroxy-s-triazine | 41 cc |
| Distilled water | 801 cc |

*Latex contains the following compound (amount: 0.4 wt. %) as an emulsifying agent.

(Emulsifying agent)

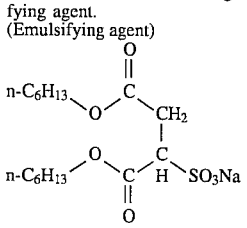

On the first undercoating layer, the following second undercoating layer was coated according to a wire bar coating method, and dried at 155° C. The second undercoating layer was also coated on the first undercoating layer on the other side of the support.

| Coating solution for second undercoating layer | (Amount: mg/m$^2$) |
|---|---|
| Gelatin | 80 |
| Dye dispersion (solid content of the dye) | 8 |
| Coating aid VI | 1.8 |
| Compound VII | 0.27 |
| Matting agent (polymethyl methacrylate, average particle size: 2.5 μm) | 2.5 |

(Coating aid VI)

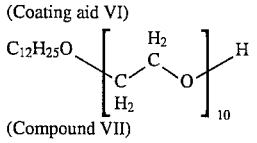

(Compound VII)

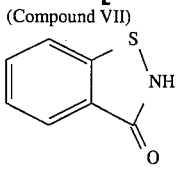

Preparation of photographic material

The emulsion layer and the surface protective layer were coated on both sides of the support according to a simultaneous extrusion method. The coating amount of silver on the one side was 1.75 g/m$^2$.

The coated samples were exposed to light for 1/100 second through a yellow filter and an optical wedge. The samples were then developed at 35° C. for 45 seconds in an automatic developing machine for X-rays (Fuji Photo Film Co., Ltd., CEPROS-M). The obtained images were evaluated. The results are set forth in Table 2.

In Table 2, the photographic sensitivity is expressed by a relative reciprocal value of the exposure required to obtain a required optical density. The relative value is defined in the manner that the value of the sample No. 10 is 100.

Further, the amount of the compound means an amount by mol based on 1 mol of silver halide. The amounts set forth in Table 2 mean the optimum amounts of the compounds, which were determined by preliminary experiments. Accordingly, the experiments were conducted based on a policy that the best results of the present invention were compared with the best results of the comparative samples.

TABLE 2

| Sample | Compound | | | Relative sensitivity | |
|---|---|---|---|---|---|
| | | | | Density | Density |
| No. | No. | Amount | Fog | 0.5 | 2.5 |
| 10 | A | $4.6 \times 10^{-6}$ | 0.24 | 100 | 100 |
| 11 | I-5 | $4.6 \times 10^{-6}$ | 0.16 | 106 | 132 |
| 12 | I-8 | $3.2 \times 10^{-6}$ | 0.20 | 100 | 121 |
| 13 | IIa-2 | $4.6 \times 10^{-6}$ | 0.18 | 96 | 120 |

Remark: A: N,N-dimethylselenourea (Disclosed in U.S. Pat. No. 3,297,447)

As is evident from the results set forth in Table 2, the selenium sensitizers of the invention reduce the occurrence of fog, compared with the conventional sensitizer. The sensitivity of the samples of the invention at the toe (density: 0.5) was almost equal to that of the comparative sample. Further, the sensitivity of the samples of the invention at the shoulder (density: 2.5) was higher than that of the comparative sample. Accordingly, the samples of the present invention form images of hard gradation.

EXAMPLE 3

To 11 of an aqueous solution containing 25 g of gelatin and 12.3 g of sodium chloride, an aqueous silver nitrate solution (1M) and an aqueous solution of sodium chloride (1M) containing $K_3IrCl_6$ ($5\times10^{-7}$ mol) were simultaneously added at 50° C. for 80 minutes while stirring. Thus cubic silver chloride emulsion (grain size: 0.5 μm) was obtained.

The resulting emulsion was desalted and washed with water according to a conventional flocculation method using a polymer flocculating agent. Then, 76 g of gelatin and water were added to the emulsion. The emulsion was adjusted to pH 6.2 and pAg 7.5 at 40° C.

The emulsion was divided into small parts. The following sensitizing dye was added to each of the parts.

(Sensitizing dye)

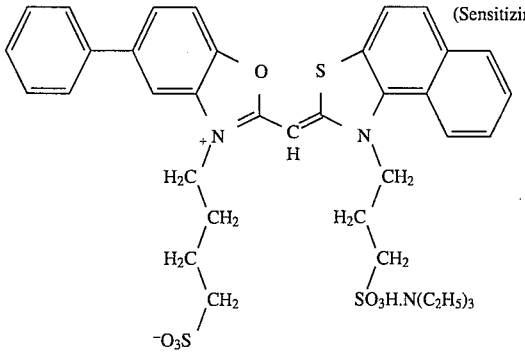

The emulsion was sensitized with the compounds set forth in Table 3 at 60° C. under optimum conditions. Then, gelatin, water, the following yellow coupler, the following color image stabilizer, 4-hydroxy-6-methyl-1,3,3a,7-tetrazaindene (stabilizing agent), 1-[3[(3-methylureido)phenyl]-5-mercaptotetrazole (antifogging agent), N-allylbenzothiazolium bromide (latent image stabilizer), sodium dodecylbenzenesulfonate (coating aid), sodium 2,4-dichloro-6-hydroxy-s-triazine (hardening agent) were added to the emulsion in the order to prepare a coating solution.

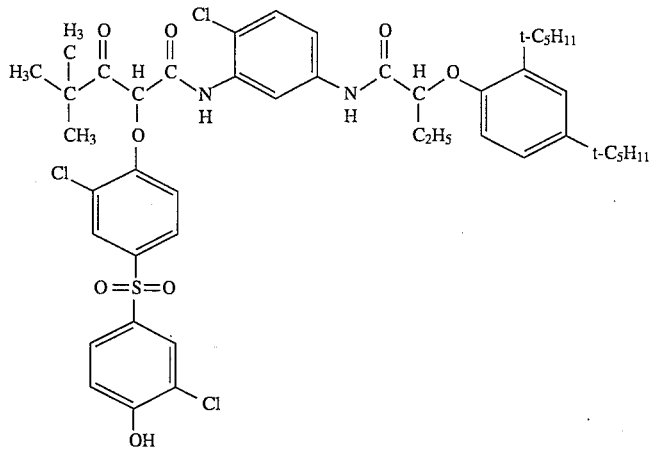

(Yellow coupler)

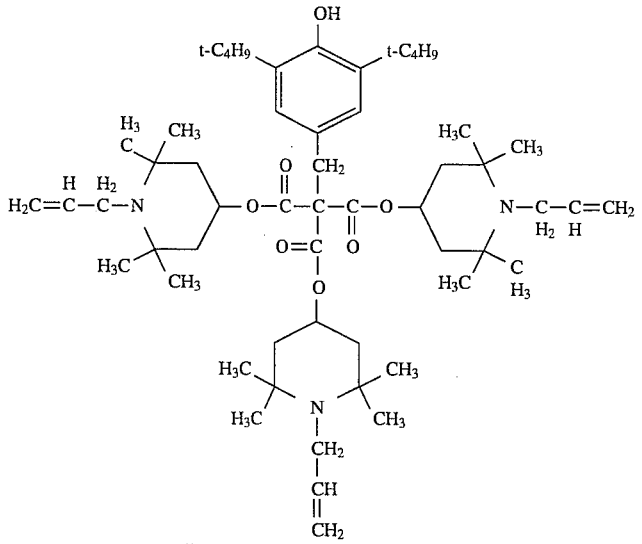

(Color image stabilizer)

On both sides of a paper support laminated with polyethylene, the above-prepared coating solution was coated with a gelatin protective layer to prepare samples.

The samples were exposed to light through an optical wedge for 1/10 second, and was subjected to the following developing process.

The color development was conducted at 33° C. for 60 seconds. The bleach-fix treatment was conducted at 35° C. for 45 seconds. The rinsing treatment was conducted at 35° C. for 90 seconds.

| Color developing solution | |
|---|---|
| Water | 800 cc |
| Diethylenetriaminepentaacetic acid | 1.0 g |
| Sodium sulfite | 0.2 g |
| N,N-diethylhydroxylamine | 4.2 g |
| Potassium bromide | 0.01 g |
| Sodium chloride | 1.5 g |
| Triethanol amine | 8.0 g |
| Potassium carbonate | 30 g |
| N-ethyl-N-(β-methanesulfoamidoethyl)-3-methyl-4-aminoaniline sulfate | 4.5 g |
| 4,4-Diaminostilbene brightening agent (Sumitomo Chemical Co., Ltd., Whitex 4) | 2.0 g |
| Water to make up to | 1,000 cc |

-continued

| | |
|---|---|
| pH (adjusted with KO) | 10.25 |
| Bleach-fix solution | |
| Ammonium thiosulfate (54 wt. %) | 150 ml |
| Sodium sulfite | 15 g |
| $NH_4$[Fe(III) (EDTA)] | 55 g |
| EDTA.2Na | 4 g |
| Glacial acetic acid | 8.61 g |
| Water to make up to | 1,000 cc |
| pH | 5.4 |
| Fixing solution | |
| Disodium ethylenediaminetetraacetate | 0.5 g |
| Ammonium sulfite | 20.0 g |
| Aqueous solution of ammonium thiosulfate (700 g/l) | 290.0 ml |
| Water to make up to | 1,000 cc |
| pH | 6.7 |
| Rinsing solution | |
| EDTA.2Na.2$H_2O$ | 0.4 g |
| Water to make up to | 1,000 cc |
| pH | 7.0 |

The obtained image was evaluated. The results are set forth in Table 3.

In Table 3, the spectral sensitivity is expressed by a relative reciprocal value of the exposure required to obtain an optical density of the fogging value plus 0.5. The relative value is defined in the manner that the value of the sample No. 20 is 100.

Further, the amount of the compound means an amount by mol based on 1 mol of silver halide. The amounts set forth in Table 3 mean the optimum amounts of the compounds, which were determined by preliminary experiments. Accordingly, the experiments were conducted based on a policy that the best results of the present invention were compared with the best results of the comparative samples.

TABLE 3

| Sample | Compound | | | Relative Sensi- |
|---|---|---|---|---|
| No. | No. | Amount | Fog | tivity |
| 20 | A | $2.4 \times 10^{-6}$ | 0.32 | 100 |
| 21 | I-5 | $2.4 \times 10^{-6}$ | 0.17 | 141 |
| 22 | I-7 | $1.2 \times 10^{-6}$ | 0.09 | 105 |

Remark: A: N,N-dimethylselenourea (Disclosed in U.S. Pat. No. 3,297,447)

As is evident from the results set forth in Table 3, the selenium sensitizers of the invention reduce the occurrence of fog and improve the sensitivity, compared with the conventional sensitizer.

EXAMPLE 4

Photographic materials 401 and 402 having the following layers were prepared (in the same manner as in Example 6 of Japanese Patent Provisional Publication No. (1994)-75328).

| No. | Layers |
|---|---|
| 15. | Second protective layer |
| 14. | First protective layer |
| 13. | High blue sensitive layer containing emulsion F |
| 12. | Middle blue sensitive layer containing emulsion D |
| 11. | Low blue sensitive layer containing emulsion C |
| 10. | Yellow filter layer |
| 9. | High green sensitive layer containing emulsion E |
| 8. | Middle green sensitive layer containing emulsion D |
| 7. | Low green sensitive layer containing emulsion C |
| 6. | Intermediate layer |
| 5. | High red sensitive layer containing emulsion E |
| 4. | Middle red sensitive layer containing emulsion D |
| 3. | Low red sensitive layer containing emulsions A & B |
| 2. | Intermediate layer |
| 1. | Antihalation layer |
| 0. | Cellulose triacetate film support |

In preparation of the sample 401, the emulsions A to F were sensitized with N,N-dimethylselenourea disclosed in U.S. Pat. No. 3,297,447 (comparative sensitizer A). In preparation of the sample 402, the emulsions A to F were sensitized with the selenium compound (I-5) of the present invention.

The samples were exposed to light through a continuous wedge at the color temperature of 4,800 K. for 1/100 second. The samples were then subjected to a color development (in the same manner as in Example 6 of Japanese Patent Provisional Publication No. 6(1994)-75328). The optical densities of the obtained images were evaluated.

Independently, the samples were stored at 50° C. and the relative humidity of 80% for 7 days. The stored samples were exposed to light and developed in the same manner as is described above. The optical densities of the obtained images were evaluated.

The differences between the fresh samples and the stored samples in the fog density and the sensitivity were measured with respect to the red sensitive layer. The results are set forth in Table 4.

In Table 4, ΔS means the difference in a logarithmic value of the exposure required to obtain an optical density of the fogging value plus 0.2.

TABLE 4

| Sample | | Difference in red sensitive layer | |
|---|---|---|---|
| No. | Compound | Fog | ΔS |
| 401 | A | 0.06 | 0.14 |
| 402 | I-5 | 0.02 | 0.07 |

As is evident from the results set forth in Table 4, the selenium compound of the invention reduce the occurrence of fog and increase the sensitivity, even if the photographic material is stored under severe conditions.

We claim:

1. A silver halide photographic material comprising a silver halide emulsion layer provided on a support, wherein the silver halide emulsion layer contains a selenium compound represented by the formula (I):

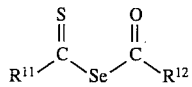

(I)

in which each of $R^{11}$ and $R^{12}$ independently is hydrogen, an aliphatic group, an aromatic group, a heterocyclic group, —$OR^{13}$ or —$NR^{14}R^{15}$; each of $R^{13}$, $R^{14}$ and $R^{15}$ independently is hydrogen, an aliphatic group, an aromatic group or a heterocyclic group; and each of $R^{11}$, $R^{12}$, $R^{13}$, $R^{14}$ and $R^{15}$ may have one or more substituent groups.

2. The silver halide photographic material as claimed in claim 1, wherein $R^{11}$ is —$NR^{14}R^{15}$.

3. The silver halide photographic material as claimed in claim 1, wherein $R^{12}$ is an aliphatic group, an aromatic group, a heterocyclic group, —$OR^{13}$ or —$NR^{14}R^{15}$.

4. The silver halide photographic material as claimed in claim 1, wherein the silver halide emulsion layer contains the selenium compound in an amount of $10^{-8}$ to $10^{-4}$ mol based on 1 mol of silver halide.

5. A silver halide photographic material comprising a silver halide emulsion layer provided on a support, wherein the silver halide emulsion is sensitized with a selenium compound represented by the formula (I):

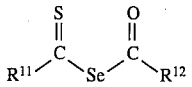

(I)

in which each of $R^{11}$ and $R^{12}$ independently is hydrogen, an aliphatic group, an aromatic group, a heterocyclic group, —$OR^{13}$ or —$NR^{14}R_{15}$; each of $R^{13}$, $R^{14}$ and $R^{15}$ independently is hydrogen, an aliphatic group, an aromatic group or a heterocyclic group; and each of $R^{11}$, $R^{12}$, $R^{13}$, $R^{14}$ and $R^{15}$ may have one or more substituent groups.

6. The silver halide photographic material as claimed in claim 5, wherein the silver halide emulsion layer is sensitized with the selenium compound in an amount of $10^{-8}$ to $10^{-4}$ mol based on 1 mol of silver halide.

7. The silver halide photographic material as claimed in claim 5, wherein the silver halide emulsion is sensitized with the selenium compound at a pAg in the range of 6 to 11.

8. The silver halide photographic material as claimed in claim 5, wherein the silver halide emulsion is sensitized with the selenium compound at a pH in the range of 3 to 10.

9. The silver halide photographic material as claimed in claim 5, wherein the silver halide emulsion is sensitized with the selenium compound at a temperature in the range of 40° to 95° C.

10. The silver halide photographic material as claimed in claim 5, wherein the silver halide emulsion is sensitized with the selenium compound in combination with a gold sensitizer.

11. The silver halide photographic material as claimed in claim 5, wherein the silver halide emulsion is sensitized with the selenium compound in the presence of a silver halide solvent.

12. A silver halide photographic material comprising a silver halide emulsion layer provided on a support, wherein the silver halide emulsion layer is sensitized with a selenium compound represented by the formula (IIa) or (IIb):

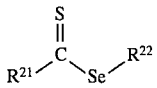

(IIa)

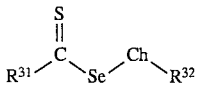

(IIb)

in which each of $R^{21}$ and $R^{31}$ is an aliphatic group, an aromatic group, a heterocyclic group or $OR^{23}$; each of $R^{22}$ and $R^{32}$ is an aliphatic group, an aromatic group or a heterocyclic group; $R^{23}$ is a hydrogen atom, an aliphatic group, an aromatic group or a heterocyclic group; each of $R^{21}$, $R^{22}$, $R^{31}$, $R^{32}$ or $R^{23}$ may have one or more substituent groups; and Ch is S, se or Te.

13. The silver halide photographic material as claimed in claim 12, wherein each of $R^{21}$ and $R^{31}$ is an aromatic group.

14. The silver halide photographic material as claimed in claim 12, wherein each of $R^{22}$ and $R^{32}$ is an aliphatic group or an aromatic group.

15. The silver halide photographic material as claimed in claim 12, wherein Ch is Se.

16. The silver halide photographic material as claimed in claim 12, wherein the silver halide emulsion layer is sensitized with the selenium compound in an amount of $10^{-8}$ to $10^{-4}$ mol based on 1 mol of silver halide.

17. The silver halide photographic material as claimed in claim 12, wherein the silver halide emulsion is sensitized with the selenium compound at a pAg in the range of 6 to 11.

18. The silver halide photographic material as claimed in claim 12, wherein the silver halide emulsion is sensitized with the selenium compound at a pH in the range of 3 to 10.

19. The silver halide photographic material as claimed in claim 12, wherein the silver halide emulsion is sensitized with the selenium compound at a temperature in the range of 40° to 95° C.

20. The silver halide photographic material as claimed in claim 12, wherein the silver halide emulsion is sensitized with the selenium compound in combination with a gold sensitizer.

21. The silver halide photographic material as claimed in claim 12, wherein the silver halide emulsion is sensitized with the selenium compound in the presence of a silver halide solvent.

* * * * *